US012416438B2

(12) United States Patent
Gregorich

(10) Patent No.: US 12,416,438 B2
(45) Date of Patent: Sep. 16, 2025

(54) DECOUPLED AND COORDINATED CONTROL OF REFRIGERATION CLIMATE CONTROL SYSTEMS

(71) Applicant: Apple Inc., Cupertino, CA (US)

(72) Inventor: Nicholas A. Gregorich, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/950,908

(22) Filed: Sep. 22, 2022

(65) Prior Publication Data

US 2024/0102712 A1 Mar. 28, 2024

(51) Int. Cl.
*F25B 30/02* (2006.01)
*F25B 49/02* (2006.01)

(52) U.S. Cl.
CPC ..... *F25B 49/022* (2013.01); *F25B 30/02* (2013.01)

(58) Field of Classification Search
CPC ..... F25B 49/022; F25B 30/02
See application file for complete search history.

(56) References Cited

U.S. PATENT DOCUMENTS

| | | | | |
|---|---|---|---|---|
| 12,000,637 | B2 | 6/2024 | Gregorich | |
| 2009/0307255 | A1* | 12/2009 | Park | G06F 16/25 707/999.102 |
| 2010/0070091 | A1 | 3/2010 | Watson et al. | |
| 2013/0098072 | A1 | 4/2013 | Choi | |
| 2016/0187013 | A1 | 6/2016 | Becker | |
| 2022/0352717 | A1 | 11/2022 | Ren | |

FOREIGN PATENT DOCUMENTS

| | | | | |
|---|---|---|---|---|
| CN | 112829540 | A * | 5/2021 | |
| EP | 2631567 | A1 * | 8/2013 | F25B 23/006 |
| EP | 1 659 739 | B1 | 9/2014 | |
| KR | 20130107148 | A * | 3/2012 | F24D 19/10 |
| WO | 2009/149084 | A2 | 12/2009 | |

OTHER PUBLICATIONS

Kim, Indoor Temperature Control System . . . , 2012, Full Document (Year: 2012).*

(Continued)

*Primary Examiner* — Nael N Babaa
(74) *Attorney, Agent, or Firm* — Kilpatrick Townsend & Stockton LLP

(57) ABSTRACT

Described herein are techniques for coordinated operation of refrigerant climate control systems in an optimized manner. In an example process, climate control information for a plurality of refrigerant climate control systems is maintained. An energy optimization signal is received that describes a characteristic associated with an electrical energy source. A set of control signals is generated for a set of refrigerant climate control systems based on climate control information and the energy optimization information. The set of control signals is then sent to a set of refrigerant climate control systems. Each control signal may be configured to cause a respective refrigerant climate control system to operate using the electricity from the electrical energy source.

20 Claims, 9 Drawing Sheets

(56) References Cited

OTHER PUBLICATIONS

Hu, Cabin environment control system . . . , 2019, Full Document (Year: 2019).*
Piesker, Cooling system with a plurality of super coolers, 2012, Full Document (Year: 2012).*
"Non-Final Office Action," mailed Jul. 27, 2023 in U.S. Appl. No. 17/950,905. 8 pages.
"Notice of Allowance," mailed Feb. 14, 2024 in U.S. Appl. No. 17/950,905. 7 pages.
"Extended Search Report," mailed Aug. 18, 2023 in European Patent Application No./Patent No. 23174085.3-1205 / U.S. Pat. No. 4,236,211. 13 pages.
U.S. Appl. No. 17/950,903, Non-Final Office Action, mailed on Mar. 20, 2025, 41 pages.

* cited by examiner

DECOUPLED AND COORDINATED CONTROL OF REFRIGERATION CLIMATE CONTROL SYSTEMS

CROSS-REFERENCES TO RELATED APPLICATIONS

This application is related to U.S. patent application Ser. No. 17/950,903 , filed Sep. 22, 2022 entitled, "Decoupled Control of Refrigerant Climate Control Systems" and U.S. patent application Ser. No. 17/950,905 , filed Sep. 22, 2022 entitled, "Mode-Based Control of a Refrigeration Climate Control System," the contents of each is herein incorporated by reference.

BACKGROUND

Heat pump systems use unique phase change properties of refrigerant to transfer heat from one location to another. In an example heat pump system, when a cooling or heating demand is needed (e.g., temperature increase or decrease), a compressor of the heat pump system is turned on to meet the demand.

BRIEF SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a computer-implemented method. The computer-implemented method includes receiving, at an energy management device, an energy optimization signal that describes a characteristic associated with an electrical energy source. The computer-implemented method also includes generating, by the energy management device, a control signal for a refrigerant climate control system to use the electrical energy source based at least in part on the characteristic of the energy optimization signal. The computer-implemented method also includes providing, by the energy management device, the control signal to a controller of the refrigerant climate control system. Other embodiments of this aspect include corresponding computer systems, apparatus, and computer programs recorded on one or more computer storage devices, each configured to perform the actions of the methods.

Another general aspect includes a computer-implemented method. The computer-implemented method includes receiving sensor data corresponding to a current state of a refrigerant in a receiver of a refrigerant climate control system. The computer-implemented method also includes receiving an energy control signal requesting operation of the refrigerant climate control system. The computer-implemented method also includes determining an operating mode of the refrigerant climate control system based on a signal type of the energy control signal and the current state of the refrigerant in the receiver. The computer-implemented method also includes instructing the refrigerant climate control system to operate in the determined operating mode. Other embodiments of this aspect include corresponding computer systems, apparatus, and computer programs recorded on one or more computer storage devices, each configured to perform the actions of the methods.

Another general aspect includes a computer-implemented method. The computer-implemented method includes maintaining climate control information for a plurality of refrigerant climate control systems located at a plurality of different locations. The computer-implemented method also includes receiving energy optimization information that describes a characteristic associated with an electrical energy source configured to provide electricity to at least some of the plurality of refrigerant climate control systems. The computer-implemented method also includes generating a set of control signals for a set of refrigerant climate control systems of the plurality of refrigerant climate control systems based at least in part on the climate control information and the energy optimization information. The computer-implemented method also includes sending the set of control signals to the set of refrigerant climate control systems, where each control signals signal is configured to cause the respective refrigerant climate control system to operate using the electricity from the electrical energy source. Other embodiments of this aspect include corresponding computer systems, apparatus, and computer programs recorded on one or more computer storage devices, each configured to perform the actions of the methods.

DETAILED DESCRIPTION

Figure 1:
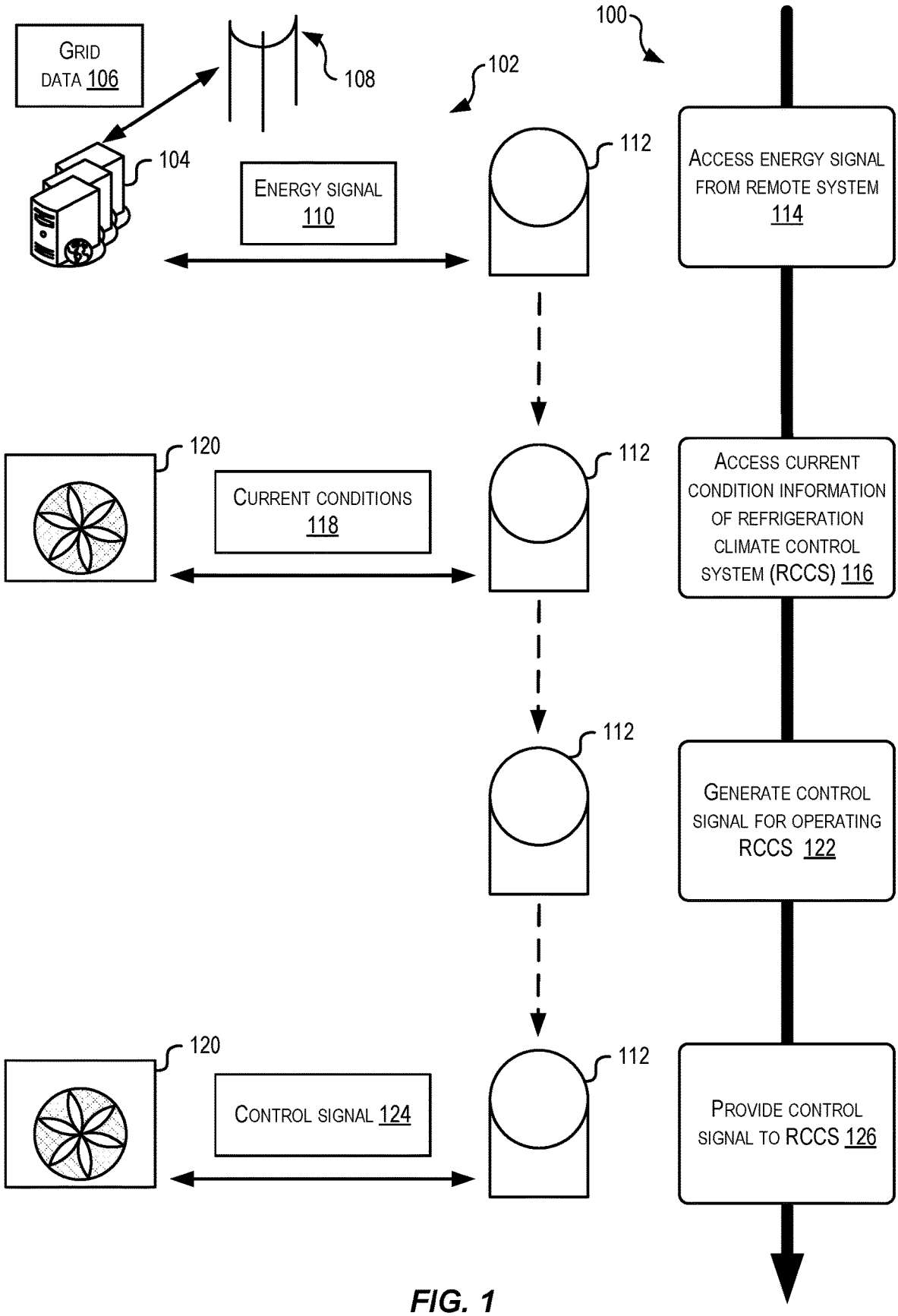
FIG. 1 illustrates a block diagram and a flowchart showing an example process for decoupled operation of refrigeration climate control systems using external optimization signals, according to at least one example.

In the following description, various examples will be described. For purposes of explanation, specific configurations and details are set forth in order to provide a thorough understanding of the examples. However, it will also be apparent to one skilled in the art that the examples may be practiced without the specific details. Furthermore, well-known features may be omitted or simplified in order not to obscure the example being described.

Examples of the present disclosure are directed to, among other things, methods, systems, devices, and computer-readable media that provide for decoupled operation of refrigeration climate control systems (RCCSs) using external optimization signals. Conventionally, an RCCS (e.g., heat pump, air conditioner, refrigerator, etc.) uses unique phase change properties of refrigerant to transfer heat from one location to another. For example, an air conditioning (AC) system may remove heat from inside to outside of a home, while a full heat pump system may also reverse the effect in order to move heat from outside to inside. The phase change refrigerant may respond well to changes in pressure, volume, and temperature (PVT). In particular, the refrigerant may be continuously changed from a liquid to a gas and back to a liquid in order to cool the home. The AC system may include a compressor, a condenser, an expansion valve, an evaporator, and a thermostat. The thermostat sends a signal to the system that cooling is required. In response, the compressor, which is a pump, turns on and takes warm vapor and increases its pressure and temperature. This vapor flows into the condenser where cooler outside air takes away heat and causes the refrigerant to condense into a liquid. This liquid flows to the expansion valve which reduces the pressure of the liquid, decreasing its temperature. This cold refrigerant is then sent through the evaporator. Warm air from inside of the home is run over the now cold evaporator, cooling the home (and heating the refrigerant). This process is repeated, e.g., the compressor runs and pumps the liquid through the system in a continuous fashion, for the duration of the cooling demand. Because of this, it is difficult, if not impossible, to time shift operation of the compressor. In other words, the compressor is coupled with the call for cooling from the thermostat.

Recently, properties about power on power grids have become more readily available. For example, some grid operators may provide signals about current electricity pricing and other signals having to do with the type of power on the grid. Such other signals may include a marginal emissions signal (e.g., a representation of what type of power generation will be required to service an additional demand) and an average emissions signal (e.g., a representation of the type of power generation that is being used for some period of time). For example, a marginal emissions signal may indicate that a current electrical load on a grid is being serviced by solar power, but any additional load may require use of a natural gas turbine. In some examples, a marginal emissions signal may be obtained by identifying which power plant provides the additional electricity requested as a result of the decision to consume at a specific time. In some examples, the average emissions signal is obtained by assessing the emissions of the mix of electricity consumed.

The technology described herein includes modifications to conventional RCCSs to enable use of signals such as those described above to decouple the operation of compressors in RCCSs from demand. For example, during a lower marginal emissions period (e.g., when load on the grid is lower), an energy management device, such as a home automation controller, may instruct a compressor of an RCCS to run, even though there is no current demand for heating or cooling. The RCCS may be modified to include a receiver that can retain excess warm high-pressure liquid and an electronic controlled expansion valve to release the warm high-pressure liquid when a call for cooling or heating is requested by a thermostat at a later time. Such configuration changes may also enable better optimized use of a local energy source. For example, the system may decide to use excess power generated by a solar system to run the compressor and fill the receiver for later use (e.g., during the evening when solar is unavailable and the system must use grid-generated power), rather than sell that excess power back into the grid. In this manner, the receiver may function more or less like a battery for storing excess energy that may then be used at a later time when operating the compressor may be less desirable (e.g., because of an environmental impact, a greater cost, etc.). Further, a controller of the RCCS may be modified to sense present conditions of the receiver (e.g., an amount of refrigerant) and based on this information and an optimization signal, decide how to operate the compressor and the expansion valve. Additionally, RCCSs that are controllable in the manner described herein may share certain information with a coordinating server that coordinates operation of many RCCSs in a given geographic region based on optimization signals. For example, the coordinating server may maintain information about the types of RCCSs in a municipality, information about the type(s) of energy sources that serve the power grid of the municipality, and other environmental or related information (e.g., current weather conditions, etc.). The coordinating server may use this information to coordinate the operation of many RCCS such that they operate in an optimized manner (e.g., with respect to costs, energy use, etc.).

Turning now to a first particular example, in this example is provided a system that includes an energy management device (e.g., a home automation controller) and an RCCS. The energy management device may be connected to an external network such as the Internet, and over this network may receive an optimization signal from a remote system (e.g., a server that maintains, aggregates, or otherwise has access to present characteristics of a power grid). The optimization signal may represent present characteristics (e.g., a current emissions signal) of the power grid or may be forecasted characteristic (e.g., a forecasted emissions signal within some time period). The energy management device may use the optimization signal to generate a control signal for the RCCS, which can be delivered to the RCCS via the Internet or other local network connection. In this example, a controller of the RCCS may use the control signal to decide whether to operate a compressor of the RCCS. For example, the control signal may be interpreted by the controller as a suggestion, rather than an explicit control instruction. In this manner, the RCCS may maintain some level of autonomy in determining how to operate.

Turning now to a second particular example, in this example is provided a system that includes a modified controller of an RCCS, a receiver with increased storage capabilities, and an electronically controlled expansion valve. The controller may receive sensor data from a sensor on the receiver. The sensor data may be indicative of a current state of a refrigerant in the receiver (e.g., a level of the liquid in the receiver). The controller may also receive an energy control signal from a thermostat (e.g., call for energy, either heat or cooling). The controller may use the information about the current state of the reservoir and the call for energy to determine an operating mode of the RCCS, which dictates operation of a compressor of the RCCS and the expansion valve. The controller may also receive an optimization signal (e.g., current and/or forecasted) that can be considered when determining the operating mode. In this manner, the controller may determine an optimal time for operating the compressor and expansion valve based on conditions of a grid, present temperature conditions, and present conditions of the receiver. In some examples, an energy management device may perform the function of the controller, which further includes delivering the instructions to the controller.

Turning now to a third particular example, in this example is provided a system that includes a coordinating server that is in network communication with many energy management devices located at many different locations (e.g., different homes) within a given region (e.g., a city). The coordinating server maintains climate control information for RCCSs located at the different locations. This information may be reported to the coordinating server by the energy management devices or may be obtained other ways. The coordinating server may also receive energy optimization signals (e.g., current and/or forecasted) that relate to energy generation source(s) of a power grid that services the region. The coordinating server generally may coordinate operation of the RCCSs based on the energy optimization signals, using the techniques described herein relating to the energy management devices, coupled with a global management approach. For example, the coordinating server may determine which of the RCCS should operate at which times considering the energy optimization signals. This may result in RCCSs operating at staggered times (e.g., at least some in parallel, followed by others at a later time) and other adjustments, as described herein.

An example operation using the techniques described herein is provided below. This example may include an RCCS being set to cool with a 72 degree F. set point and +/−1 degree F. operation window. When the sensed temperature is 72 degrees F., the RCCS is not expected to run for some amount of time (e.g., another fifteen minutes). But, if the energy management device receives a marginal emissions signal that indicates a very low value for five minutes, the RCCS may be opportunistically operated by turning on the compressor for five minutes. During this time period, liquid refrigerant may be stored in the receiver, but not immediately sent to the expansion valve. This operation is done at a very low emissions cost because of the low emissions signal. If the energy management device receives a marginal emissions signal that indicates a high value for thirty minutes and the thermostat reaches 73 degrees F., the RCCS expansion valve may be opened to serve the demand from the receiver, without operating the compressor. For example, the home may be cooled for five minutes off of the refrigerant in the receiver, rather than from the compressor. This enables operation without having to run the compressor during the period of high emissions costs.

The example of the described technology addresses a number of technical problems and provides for a number of technical improvements. For example, in addition to others described herein, the technology addresses the problem of having to operate a compressor of an RCCS only when requested by a thermostat. In other words, because the operation of the compressor is decoupled from a call for energy from the thermostat, the RCCS can be operated in ways that save and/or otherwise conserve energy, reduce cost as compared to coupled systems, and reduce emissions of greenhouse gases (e.g., by time-shifting or operating when certain lower-emission or zero emissions generation is servicing the demand). A coordinating server may enable optimization at a larger scale, which may result in an even higher reduction in greenhouse gas emissions, as compared to conventional siloed operation of RCCSs.

Turning now to the figures, FIG. 1 illustrates a block diagram 102 and a flowchart showing a process 100 for decoupled operation of refrigeration climate control systems (RCCSs) using external optimization signals, according to at least one example.

FIGS. 1 and 6-8 illustrate example flow diagrams showing processes 100, 600, 700, and 800, according to at least a few examples. These processes, and any other processes described herein, are illustrated as logical flow diagrams, each operation of which represents a sequence of operations that can be implemented in hardware, computer instructions, or a combination thereof. In the context of computer instructions, the operations may represent computer-executable instructions stored on one or more non-transitory computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described operations can be combined in any order and/or in parallel to implement the processes.

Additionally, some, any, or all of the processes described herein may be performed under the control of one or more computer systems configured with specific executable instructions and may be implemented as code (e.g., executable instructions, one or more computer programs, or one or more applications) executing collectively on one or more processors, by hardware, or combinations thereof. As noted above, the code may be stored on a non-transitory computer-readable storage medium, for example, in the form of a computer program including a plurality of instructions executable by one or more processors.

The diagram 102 includes a remote system 104, which is any suitable combination of computing devices such as one or more server computers, which may include virtual resources, capable of performing the functions described with respect to the remote system 104. For example, the remote system 104 may include one or more different servers and/or services dedicated to maintaining, aggregating, or otherwise accessing grid data 106 about one or more electric grids 108. The grid data 106 may include cost information, energy source information, and the like. The remote system 104 may access the grid data 106 in order to generate one or more energy optimization signals 110, such as those described herein. In some examples, the grid data 106 may be the energy optimization signals 110, and the remote system 104 may pass the energy optimization signals 110 through to energy management devices such as to an energy management device 112. The energy management device 112 may include a suitable combination of computing resources capable of performing the techniques described herein. In a particular example, the energy management device 112 may include a home automation controller, which may interface with one or more accessory devices in a connected home environment. The energy optimization signals 110 may be forecasted signals, or, in some examples, the energy management device 112 may forecast certain characteristics based on the energy optimization signals 110. Forecasting may be helpful for determining when to operate an RCCS 120 based not only on the current conditions, but also on future conditions. For example, if a current emissions signal was moderately high alone, the techniques described herein may decide not to operate the RCCS 120 (e.g., not turn on a compressor). However, if a forecasted emissions signal indicates that emissions are going to be even higher in the next hour, the techniques described herein may decide to operate the RCCS 120 during the moderately high emissions window rather than very high emissions window. This approach will still result in a reduction of carbon attributable to the RCCS 120 because operating in the very high emissions window is avoided.

As introduced herein, at block 114, the process 100 includes the energy management device 112 accessing the energy optimization signal 110 from the remote system 104. At block 116, the process 100 includes the energy management device 112 accessing current condition information 118 of an RCCS 120. The current condition information 118 may include information about present conditions of the RCCS 120. For example, such current condition information 118 may include current temperature, whether a thermostat has been made for heating or cooling, a setpoint in the thermostat, a fill level of the receiver, a state of a compressor, a state of an expansion valve, and any other operational and/or state of the RCCS 120 and the environment in which the RCCS 120 operates.

At block 122, the process 100 includes the energy management device 112 generating a control signal 124 for operating the RCCS 120, and at block 126, providing the control signal 124 to the RCCS 120. The control signal 124, depending on the embodiment, may function as a suggestion at one extreme and as an instruction at the opposite extreme.

For example, the control signal 124 may include a binary flag that suggests operation of a compressor of the RCCS 120, e.g., this is a good time to run the compressor. In a different example, the control signal 124 may include an instruction that the RCCS 120 run the compressor (e.g., turn on the compressor). In some examples, a controller of the RCCS 120 may apply additional logic to the control signal 124 to determine how to operate the RCCS 120.

Figure 2:
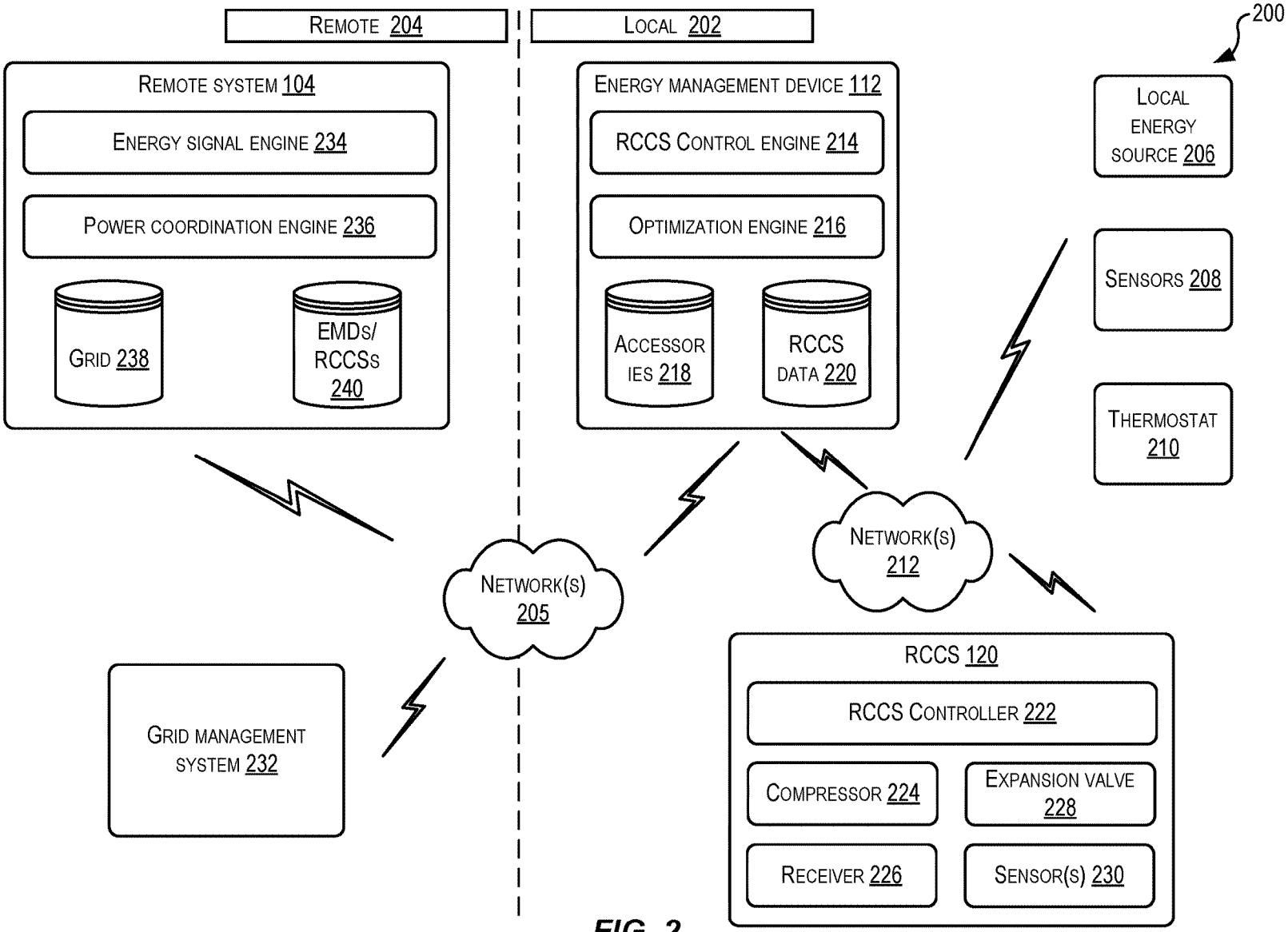
FIG. 2 illustrates a block diagram showing an example architecture or system for decoupled operation of refrigeration climate control systems using external optimization signals, according to at least one example.

FIG. 2 illustrates a block diagram showing an example architecture or system 200 for decoupled operation of refrigeration climate control systems using external optimization signals, according to at least one example. The system 200 includes system elements within a local area 202 and those in a remote area 204, e.g., those that are remote with respect to the local area 202. In some examples, the local area 202 may correspond to a home, business, or a location that may generally have independent control of RCCSs onsite (e.g., heating, cooling, food refrigeration, etc.). Elements of the remote area 204 may communicate with elements of the local area 202 via one or more networks 205.

Within the local area 202, the system 200 includes the energy management device 112, one or more RCCS 120, a local energy source 206, sensor(s) 208, and a thermostat 210, which may communicate via a network 212. The network 205 and the network 212 may be the same network or may be different networks. The networks 205 and 212 may be any suitable combination of wired, wireless, cellular, Internet, and the like.

In some examples, the number of thermostats 210 may correspond to the number of RCCSs 120. For example, as the techniques described herein may be applied to any suitable RCCS (e.g., a heat pump system, a residential AC system, a refrigerator, a freezer, an automobile AC system, and the like), each RCCS may include its own thermostat for user-control of the respective RCCS 120. In some examples, the energy management device 112 may include logic to control other elements of the local area 202, which may include performing at least some of the functionality of the thermostat(s) 210. The sensors 208 may include temperature sensors, humidity sensors, optical sensors, cameras, presence sensors, and the like disposed throughout the local area 202 in order to sense present conditions within the local area 202 (e.g., within a building, outside of the building, on the local energy source 206, etc.). The local energy source 206 may include a local power generation source such as a local wind turbine, local solar power, local generator, battery storage, and the like. In some examples, information about the local energy source 206 may be used by the energy management device 112 to control operation of the RCCS 120. For example, the energy management device 112 may decide to use a local energy source 206 (e.g., a solar power source) to run a compressor (even though nobody is home and the thermostat 212 is not call of demand) because doing so would optimize use of the sun and capacity exists in the RCCS 120.

The energy management device 112 includes an RCCS control engine 214, an optimization engine 216, an accessory database 218, and RCCS data database 220. Generally, the optimization engine 216 may be configured to receive energy optimization signals and other information described herein and, running one or more optimization algorithms, decide an optimization plan. Generally, the RCCS control engine 214 may be configured to use the optimization to generate control signals for controlling the RCCS 120. In some examples, the energy management device 112 may control/optimize operation of multiple RCCSs 120. The accessory database 218 may include connection, state, operation, etc. information about accessories that are connected to the energy management device 112. This may include the RCCS 120, the local energy source(s) 206, the sensors 208, the thermostat(s) 210, and other accessories (e.g., connected lights, cameras, appliances, televisions, other home automation hubs, other home automation devices, and the like). The RCCS data database 220 may include information that is specific to the RCCS 120, which may include connection, state, operation, and similar information useable by the energy management device 112 to perform the techniques described herein.

The RCCS 120 includes an RCCS controller 222, a compressor 224, a receiver 226, an expansion valve 228, and sensor(s) 230. These elements will be described in more detail with reference to later figures. Generally, the RCCS controller 222 may enable communications with the energy management device 112 (and other elements in the local area 202), the remote system 10, and other entities described herein. The RCCS controller 222 may also control the controllable elements of the RCCS 120, such as the compressor 224 and the expansion valve 228.

The system 200 also includes, within the remote area 204, the remote system 104 and a grid management system 232. Generally, the remote system 104 may be any suitable computer system, including combinations of server computers (e.g., virtual or physical), configured to perform the operations described herein. The remote system 104 includes an energy signal engine 234, a power coordination engine 236, a grid database 238, and an energy management device (EMD)/RCCS database 240.

Generally, the energy signal engine 234 may be configured to provide the energy optimization signals described herein. In some examples, the energy signal engine 234 may access the energy optimization signals from the grid management system 232 or other service that provides such signals. In some examples, the remote system 104 may generate the signals based on logic specific to the remote system 104.

Generally, the power coordination engine 236 may be configured to coordinate operation of multiple EMDs and/or RCCSs, as described herein. This may include using the energy signal engine 234 to send unique or generic control signals to certain EMDs and/or RCCSs. In some examples, the remote system 104 may be referred to as a coordination server or coordination system when the power coordination engine 236 is included therein.

The grid database 238 may be configured to store information about electrical grids, power generation sources that serve specific grids, and the like. This may include geographic information such as boundaries, addresses, regions, municipalities, and the like. The power generation source information may include generation type (e.g., coal, solar, wind, natural gas, hydroelectric, etc.), pricing tables for each location, and the like. In some examples, the remote system 104 may use the grid database 238 to generate energy optimization signals, in addition to or as an alternative to obtaining such signals from a different system (e.g., the grid management system 232) or via a service (e.g., an API call to an energy service).

The EMD/RCCSs database 240 may be used to store information about the EMDs and RCCSs from the local area 202 and other similar local areas. This may include location information (e.g., addresses, zones, coordinates, cities, counties, etc.), capacity and capability information (e.g., tonnage information for heat pump and AC systems, current load, quantities in receivers, etc.), and state information (e.g., states of components of RCCSs and the like). In some examples, the energy management device 112 (and other EMDs) may share information from the RCCS data database 220 with the remote system 104, and the remote system 104 may use the information to update the EMDs/RCCSs database 240.

Figure 3:
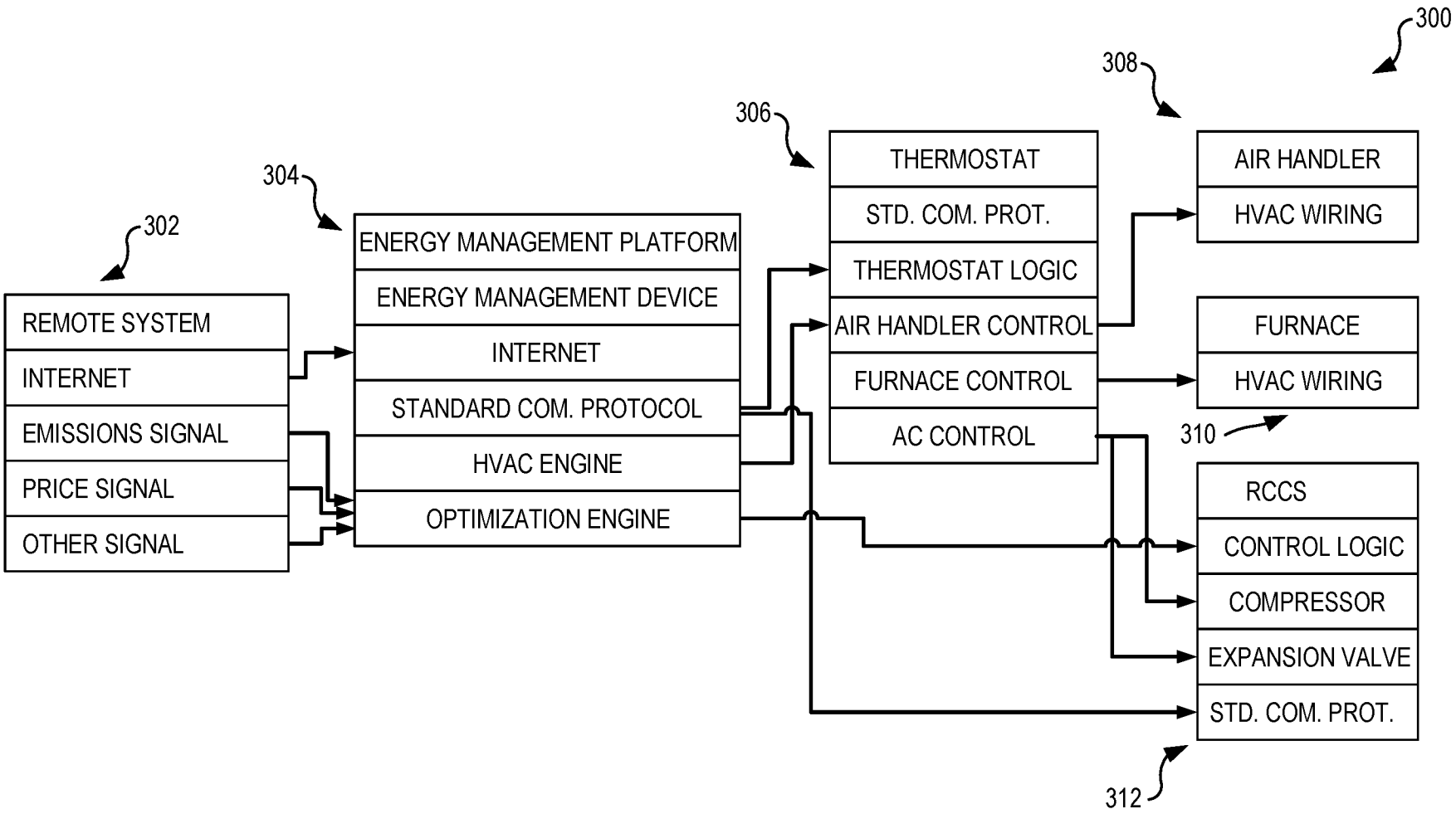
FIG. 3 illustrates a block diagram showing an example schematic for decoupled operation of refrigeration climate control systems using external optimization signals, according to at least one example.

FIG. 3 illustrates a block diagram showing an example schematic 300 for decoupled operation of refrigeration climate control systems using external optimization signals, according to at least one example. The schematic 300 represents, schematically, elements of different systems previously described herein. In particular, the schematic 300 includes a remote system 302 (e.g., the remote system 104), an energy management platform 304 (e.g., a platform that includes the energy management device 112), a thermostat 306 (e.g., the thermostat 210), an air handler 308, a furnace 310, and an RCCS 312 (e.g., the RCCS 120).

The remote system 302 includes an internet connection and obtains, generates, maintains, and/or shares certain signals such as emissions signals, price signals, and other signals. The remote system 302 may share the signals via the Internet with the energy management platform 304 that includes an internet connection.

The energy management platform 304, e.g., an optimization engine (e.g., the optimization engine 216) in particular, may use the signals to perform the techniques described herein. The energy management platform 304 may also include an HVAC engine (e.g., the RCCS control engine 214) configured to provide control signals to the thermostat 306 relating to operation of HVAC components. The energy management platform 304 may communicate with the thermostat 306 via one or more standard communication protocols (e.g., Thread, Matter, etc.). This may include sending thermostat controls to thermostat control logic of the thermostat 306. The HVAC engine may send control signals to the air handler control logic of the thermostat 306. The optimization engine of the energy management platform 304 may send its signals (e.g., the signals from the remote system 302) to control logic (e.g., RCCS controller 222).

The thermostat 306 may also communicate with other elements via standard communication protocols. The thermostat 306 may include air handler control logic that provides control signals to HVAC wiring of the air handler 308. Similarly, the furnace control of the thermostat 306 may send control signals to HVAC wiring of the furnace 310.

The RCCS 312 may include the control logic (e.g., the RCCS controller 222), a compressor (e.g., the compressor 224), and an expansion valve (e.g., the expansion valve 228), and may communicate via standard communication protocols. In some examples, certain control signals, which control the RCCS 312, may originate within the thermostat 306 and/or the energy management platform 304.

Figure 4:
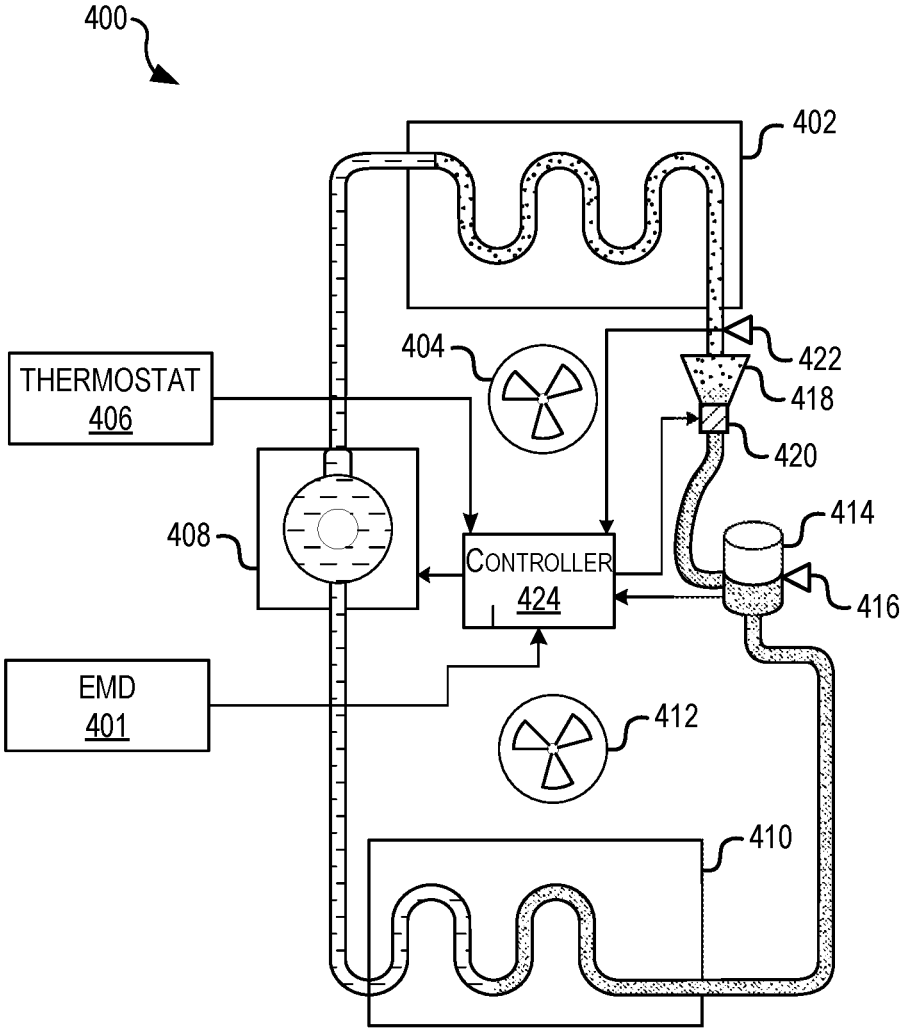
FIG. 4 illustrates a schematic of an example refrigeration climate control system, according to at least one example.

FIG. 4 illustrates a schematic of an example refrigeration climate control system (RCCS) 400, according to at least one example. The RCCS 400 is an example of the RCCS 120 and 312. The RCCS 400 is depicted schematically to illustrate the operation of the RCCS 400. The RCCS 400 includes an evaporator 402 and evaporator fan 404, a compressor 408 (e.g., the compressor 224), a condenser 410 and condenser fan 412, a receiver 414 (e.g., the receiver 226), receiver sensor(s) 416 (e.g., the sensors 230), an expansion valve 418 (e.g., the expansion valve 228), an expansion valve controller 420, expansion valve sensor(s) 422 (e.g., the sensors 230), and an RCCS controller 424 (e.g., the RCCS controller 222). The RCCS 400 may be in network and/or electric communication with a thermostat 406 (e.g., the thermostat 210) and an energy management device 401 (e.g., the energy management device 112).

Generally, the RCCS controller 424 may receive sensor data from the sensors 416 and 422 (and other data from a thermostat 406 and/or an energy management device 401), process such data, and send control signals for controlling the compressor 408 and the expansion valve controller 420.

Under normal operation, the compressor 408 compresses warm low pressure vapor (received from the evaporator 402) to output hot high pressure vapor that travels into the condenser 410. As the condenser fan 412 blows cool air over the condenser 410, heat is transferred from the hot high pressure vapor into the cool air, warming the cool air to produce warm air and causing the hot vapor to condense into warm high pressure liquid. The warm high pressure liquid may then be stored in the receiver 414. The receiver 414 may be oversized as compared to conventional receivers. For example, the receiver 414 may be oversized by 10%, 20%, 30%, 40%, 50%, 100%, 200% or even larger as compared to a conventional receiver used in a conventional system. The extra capacity of the receiver 414 may enable storage of large quantities of compressed refrigerant in the receiver 414 for use at a later time (e.g., after the compressor has stopped running and the demand is required).

Figure 5:
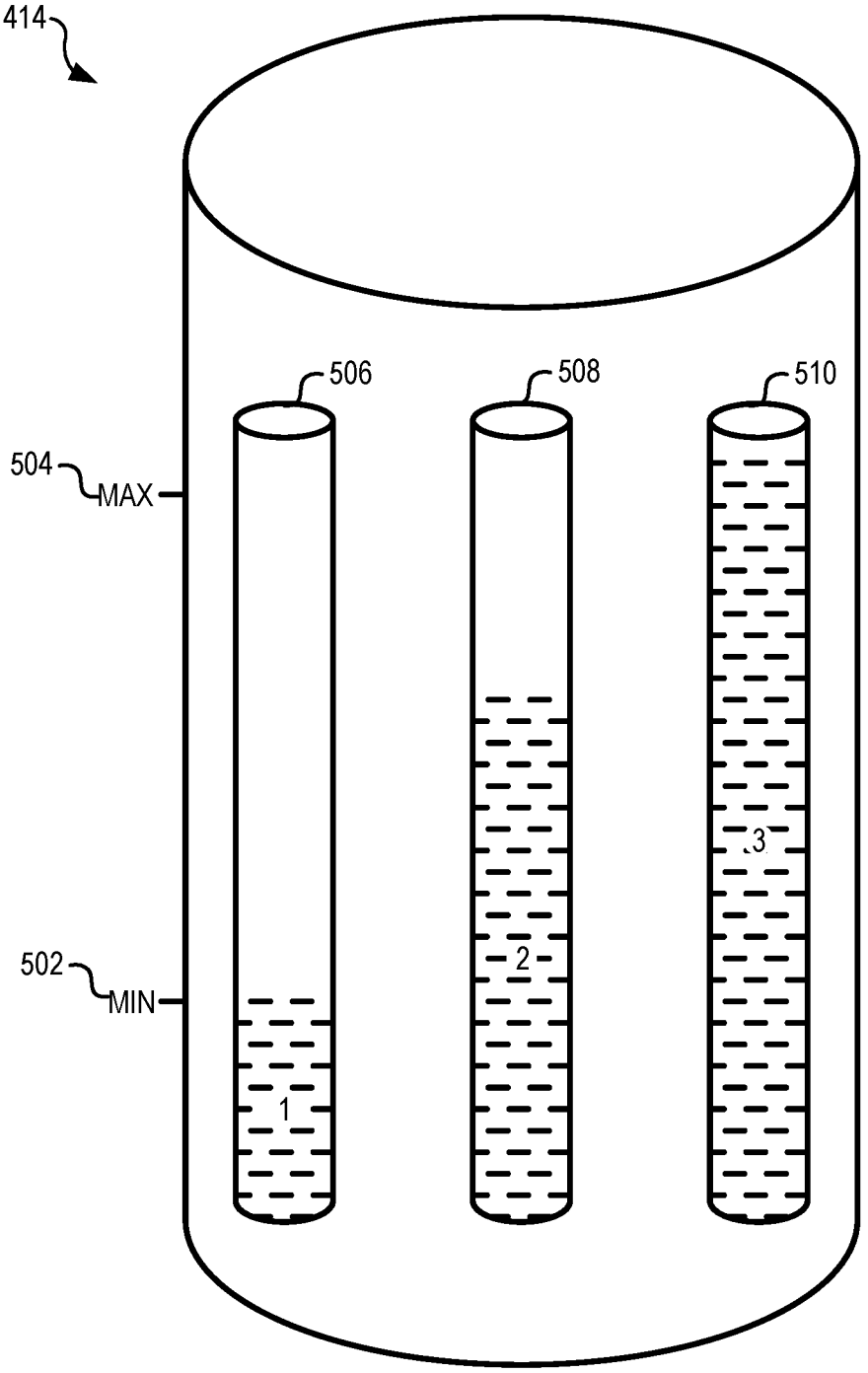
FIG. 5 illustrates a schematic of an example receiver of a refrigeration climate control system, according to at least one example.

The receiver sensor(s) 416 may sense conditions of the receiver 414, before, during, and after the warm high pressure liquid has been moved into the receiver 414. Such conditions may include pressure, temperature, volume, and the like. In some examples, the sensor data from the sensors 416 may be used to derive a fullness level of the receiver 414. The fullness level may be used by the RCCS controller 424 to decide how to operate the compressor 408, the expansion valve 418, and either of the fans 404 and 412. FIG. 5 illustrates example fullness levels of the receiver 414.

In particular, FIG. 5 illustrates a schematic of an example of the receiver 414 of a refrigeration climate control system, according to at least one example. The interior volume of the receiver 414 may be divided into two or more divisions or parts. As illustrated, the interior volume may be measured relative to a minimum amount 502 and a maximum amount 504. FIG. 5 illustrates an example of a first quantity 506 of refrigerant in the receiver 414 that is less than or equal to the minimum amount 502, an example of a second quantity 508 that is between the minimum level 502 and the maximum level 504, and a third quantity 510 that is greater than or equal to the maximum level 504. In some examples, the sensors 416 may be used to gather sensor data that indicates the fullness level or may be used by the RCCS controller 424 or other logic to derive the fullness level.

Returning to FIG. 4, the expansion valve controller 420 may be opened to let the warm high pressure liquid from the receiver 414 travel through the expansion valve 418. This process changes the liquid to a vapor and cools the refrigerant. The expansion valve sensors 422 may sense conditions of the refrigerant prior to, during, and/or after the refrigerant has passed through the expansion valve 418. The cool low pressure vapor may then be passed through the evaporator 402 and the evaporator fan 404 may blow warm air over the evaporator 402. This action functions to cool the warm air and deliver cool air on the other side of the evaporator. This process continues.

As described, the technology described herein allows opportunistic pre-running of the compressor 408 during intelligentially determined times to store pre-compressed refrigerant in the receiver 414 without cooling or heating the home at the same time. This also enables a time-shifting cooling effect to a later time that may have sub-optimal conditions to run the compressor. In some examples, the thermostat 406 may provide conventional signals such as a run cooling system signal, while also providing additional control signals including a pre-compress signal. The pre-compress signal may also come from the EMD 401.

Returning to FIG. 5, now a few example operating modes for the RCCS 400 will be described. As a first example operating mode (e.g., a first demand fill mode), when the sensors 416 indicate that the level of the receiver 414 is below the minimum level 502 (e.g., the first quantity 506) and the RCCS controller 424 receives a temperature control signal (e.g., a call for a temperature change from the thermostat 406 and/or the EMD 401), the controller 424 may instruct the compressor 408 to run and the expansion valve 418 to open. Because the refrigerant in the receiver 414 is below the minimum level 502, there may not be sufficient refrigerant in the receiver 414 to meet the call for temperature change. Because there is a call for temperature change, the expansion valve 418 is opened. And for both of these reasons, the compressor 408 is turned on to fill the receiver 414 and/or move the refrigerant through the system to meet the demand.

As a second example mode (e.g., a first no demand fill mode), when the sensors 416 indicate that the level of the receiver 414 is below the minimum level 502 (e.g., the first quantity 506) and the RCCS controller 424 receives a pre-compress control signal (e.g., a call from the EMD 401 that it is good time to operate), the controller 424 may instruct the compressor 408 to run and the expansion valve 418 to close. Because there is no call for heating or cooling, the system expansion valve 418 may be closed and the compressor 408 turned on in order to fill the receiver 414 with more refrigerant. In some examples, in this mode, the RCCS 400 may operate at least until the refrigerant in the receiver 414 meets or exceeds the maximum level 504 or a call for heating or cooling is received.

As a third example mode (e.g., a first demand no fill mode), when the sensors 416 indicate that the level of the receiver 414 is between the minimum level 502 (e.g., the first quantity 506) and the maximum level 504 (e.g., the second quantity 508) and the RCCS controller 424 receives a temperature control signal (e.g., a call for a temperature change from the thermostat 406 and/or the EMD 401), the controller 424 may instruct the compressor 408 to not run and the expansion valve 418 to open. Because the refrigerant in the receiver 414 is of a sufficient level, there may be sufficient refrigerant in the receiver 414 to meet the call for temperature change. Thus, because there is a call for temperature change, the expansion valve 418 is opened and the demand is served from the refrigerant in the receiver 414, without operating the compressor 408.

As a fourth example mode (e.g., a second no demand fill mode), when the sensors 416 indicate that the level of the receiver 414 is between the minimum level 502 (e.g., the first quantity 506) and the maximum level 504 (e.g., the second quantity 508) and the RCCS controller 424 receives a pre-compress control signal (e.g., a call from the EMD 401 that it is good time to operate), the controller 424 may instruct the compressor 408 to run and expansion valve 418 to close. Because there is no call for heating or cooling, the expansion valve 418 may be closed and the compressor 408 turned on in order to fill the receiver 414 with more refrigerant. In some examples, in this mode, the RCCS 400 may operate at least until the refrigerant in the receiver 414 meets or exceeds the maximum level 504 or a call for heating or cooling is received.

As a fifth example mode (e.g., a second demand no fill mode), when the sensors 416 indicate that the level of the receiver 414 meets or exceeds the maximum level 504 (e.g., the second quantity 508) and the RCCS controller 424 receives a temperature control signal (e.g., a call for a temperature change from the thermostat 406 and/or the EMD 401), the controller 424 may instruct the compressor 408 to not run and the expansion valve 418 to open. Because the refrigerant in the receiver 414 is of a sufficient level, there may be sufficient refrigerant in the receiver 414 to meet the call for temperature change. Thus, because there is a call for temperature change, the expansion valve 418 is opened and the demand is served from the refrigerant in the receiver 414, without operating the compressor 408.

As a sixth example mode (e.g., a no action mode), when the sensors 416 indicate that the level of the receiver 414 meets or exceeds the maximum level 504 (e.g., the second quantity 508) and the RCCS controller 424 receives a pre-compress control signal (e.g., a call from the EMD 401 that it is good time to operate), the controller 424 may instruct no actions. This is because there is no call for heating or cooling and the compressor 408 has already filled the receiver 414 up to the maximum level 504.

Figure 6:
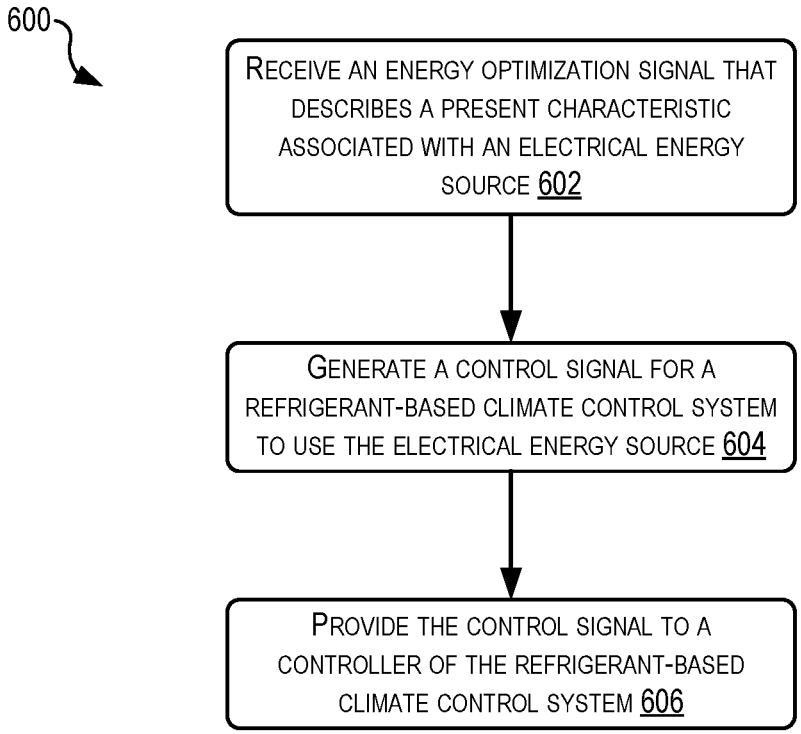
FIG. 6 illustrates a flow chart showing an example process for decoupled operation of refrigeration climate control systems using external optimization signals, according to at least one example.

FIG. 6 illustrates a flow chart showing an example process 600 for decoupled operation of refrigeration climate control systems using external optimization signals, according to at least one example. In particular, FIG. 6 depicts an embodiment in which the energy management device 112 receives an optimization signal about an electrical energy source, determines whether to use the source, generates a control signal for an RCCS (e.g., heat pump, AC, refrigerator, etc.), and provides the signal to the RCCS.

The process 600 begins at block 602 by the energy management device 112 receiving an energy optimization signal that describes a characteristic associated with an electrical energy source. Receiving the energy optimization signal may include receiving the energy optimization signal from a remote system (e.g., the remote system 104) that monitors characteristics associated with the electrical energy source. The characteristic may include a current characteristic (e.g., a current price, a current emissions signal, etc.) or a forecasted characteristic (e.g., a forecasted price, a forecasted emissions signal, etc.).

In some examples, the electrical energy source may include an electrical energy grid including a plurality of energy generation sources. In this example, the energy optimization signal may include at least one of a marginal emissions signal, an average emissions signal, a price signal, or a time signal. In some examples, the electrical energy source may include a residential power generation system (e.g., local energy source 206).

In some examples, the energy management device may include a home automation system configured to control operation of connected accessories at a dwelling. In this example, the refrigerant climate control system may include an air conditioning system or a heat pump system of the dwelling.

In some examples, the electrical energy source may include at least one of a residential solar generation system or a residential battery power system.

At block 604, the process 600 includes the energy management device 112 generating a control signal for a refrigerant climate control system (e.g., the RCCS 120) to use the electrical energy source based at least in part on the characteristic of the energy optimization signal.

In some examples, generating the control signal for the refrigerant climate control system may include optimizing electrical energy use of the refrigerant climate control system based on the energy optimization signal. Such optimizing may include minimizing the greenhouse gas emissions attributable to the operation of the refrigerant climate control system, minimizing costs attributable to the operation of the refrigeration climate control system, and minimizing or maximizing other operational parameters described herein.

In some examples, the control signal may include a binary flag. In this example, in a first state of the binary flag, the binary flag may be interpreted by the controller of the refrigerant climate control as a first suggestion to operate a compressor of the refrigerant climate control system. In this example, in a second state of the binary flag, the binary flag may be interpreted by the controller of the refrigerant climate control as a second suggestion to refrain from operating the compressor of the refrigerant climate control system.

In some examples, the control signal may include a set of instructions that, when executed by the controller, cause the controller to operate a compressor of the refrigerant climate control system in one of a plurality of modes, such as those described with reference to FIGS. 4 and 5. In some examples, the plurality of modes may include a first mode that fills a receiver of the refrigerant climate control system, and a second mode that serves current demand of the refrigerant climate control system.

At block 606, the process 600 includes the energy management device 112 providing the control signal to a controller of the refrigerant climate control system (e.g., the RCCS controller 222 of the RCCS 120). This may include sending the signal to the refrigerant climate control system.

Figure 7:
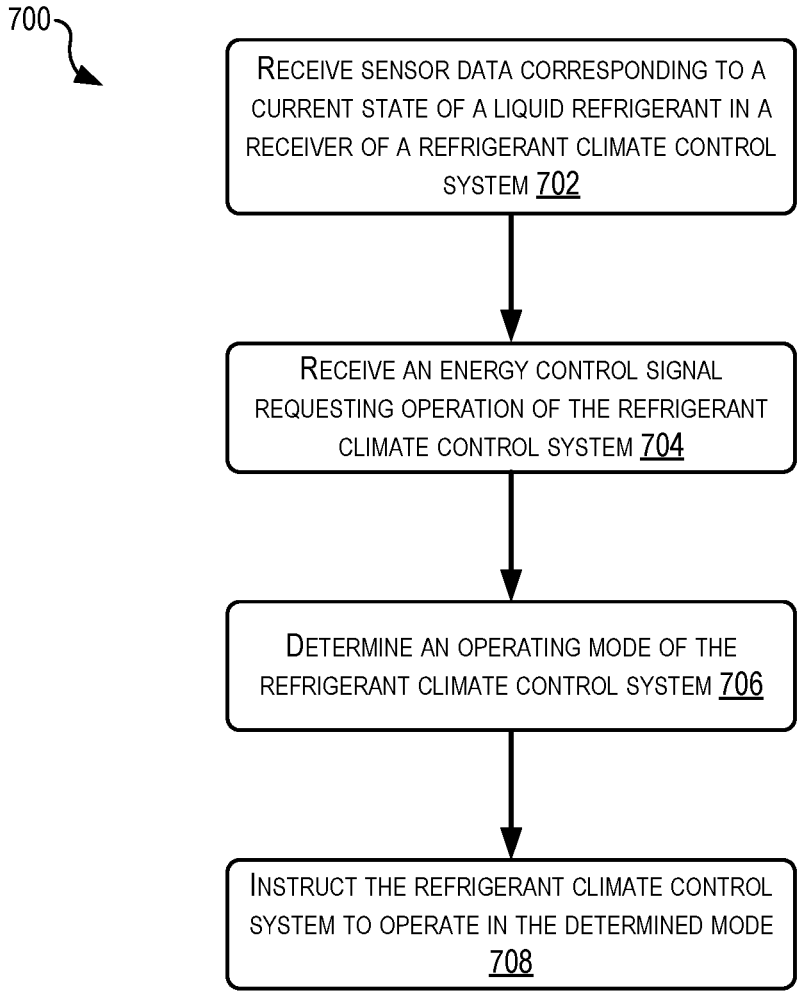
FIG. 7 illustrates a flow chart showing an example process for decoupled operation of refrigeration climate control systems using external optimization signals and receiver sensor data, according to at least one example.

FIG. 7 illustrates a flow chart showing an example process 700 for decoupled operation of refrigeration climate control systems using external optimization signals and receiver sensor data, according to at least one example. In particular, FIG. 7 depicts an embodiment in which the RCCS controller 222 (or the energy management device 112) that controls modes of the RCCS 120 opportunistically. This may include balancing temperature demand signals and pre-compress control signals fill a receiver opportunistically.

The process 700 begins at block 702 by the RCCS controller 222 receiving sensor data corresponding to a current state of a refrigerant in a receiver of a refrigerant climate control system. The sensor data may include pressure, volume, temperature, and the like, which may be used to determine a fill level (e.g., current state) of the refrigerant.

At block 704, the process 700 includes the RCCS controller 222 receiving an energy control signal requesting operation of the refrigerant climate control system. The energy control signal may be one or more of a variety of signals described herein. In some examples, an energy management device may send the control signal, which may be an energy optimization signal and be indicative of a good time to operate the compressor of the RCCS.

At block 706, the process 700 includes the RCCS controller 222 determining an operating mode of the refrigerant climate control system based on a signal type of the energy control signal and the current state of the refrigerant in the receiver. In some examples, the signal type may include at least one of a setpoint signal (e.g., from a thermostat) or an energy optimization signal (e.g., from an energy management device).

In some examples, the operating mode may include one of a plurality of operating modes corresponding to selective operation of a compressor of the refrigerant climate control system and selective operation of an expansion valve of the refrigerant climate control system.

In some examples, determining the operating mode may include determining the operating mode as a first operating mode of the plurality of operating modes when the sensor data indicates that the current state is below a minimum value of refrigerant in the receiver and the type of energy control signal comprises a temperature control signal. In this example, in the first operating mode, the refrigerant climate control system operates the compressor of the refrigerant climate control system and opens the expansion valve of the refrigerant climate control system. The first operating mode may be the first demand fill operating mode.

In some examples, determining the operating mode may include determining the operating mode as a second operating mode of the plurality of operating modes when the sensor data indicates that the current state is below a minimum value of refrigerant in the receiver and the type of energy control signal comprises a pre-compress control signal. In this example, in the second operating mode, the refrigerant climate control system operates the compressor of the refrigerant climate control system and closes the expansion valve of the refrigerant climate control system. The second operating mode may be the first no demand fill mode.

In some examples, determining the operating mode may include determining the operating mode as a third operating mode of the plurality of operating modes when the sensor data indicates that the current state is between a minimum value and maximum value of refrigerant in the receiver and the type of energy control signal comprises a temperature control signal. In this example, in the third operating mode, the refrigerant climate control system refrains from operating the compressor of the refrigerant climate control system and opens the expansion valve of the refrigerant climate control system. The third operating mode may be the first demand no fill mode.

In some examples, determining the operating mode may include determining the operating mode as a fourth operating mode of the plurality of operating modes when the sensor data indicates that the current state is between a minimum value and maximum value of refrigerant in the receiver and the type of energy control signal comprises a pre-compress control signal. In this example, in the fourth operating mode, the refrigerant climate control system operates the compressor of the refrigerant climate control system and closes the expansion valve of the refrigerant climate control system. The fourth operating mode may be the second no demand fill mode.

In some examples, determining the operating mode may include determining the operating mode as a fifth operating mode of the plurality of operating modes when the sensor data indicates that the current state exceeds a maximum value of refrigerant in the receiver and the type of energy control signal comprises a temperature control signal. In this example, in the fifth operating mode, the refrigerant climate control system refrains from operating the compressor of the refrigerant climate control system and closes the expansion valve of the refrigerant climate control system. The fifth operating mode may be the second demand no fill mode.

In some examples, determining the operating mode may include determining the operating mode as a sixth operating mode of the plurality of operating modes when the sensor data indicates that the current state exceeds a maximum value of refrigerant in the receiver and the type of energy control signal comprises a pre-compress control signal. In this example, in the sixth operating mode, the refrigerant climate control system refrains from operating the compressor of the refrigerant climate control system and refrains from operating the expansion valve of the refrigerant climate control system. The sixth operating mode may be the no action mode.

At block 708, the process 700 includes the RCCS controller 222 instructing the refrigerant climate control system to operate in the determined operating mode.

Figure 8:
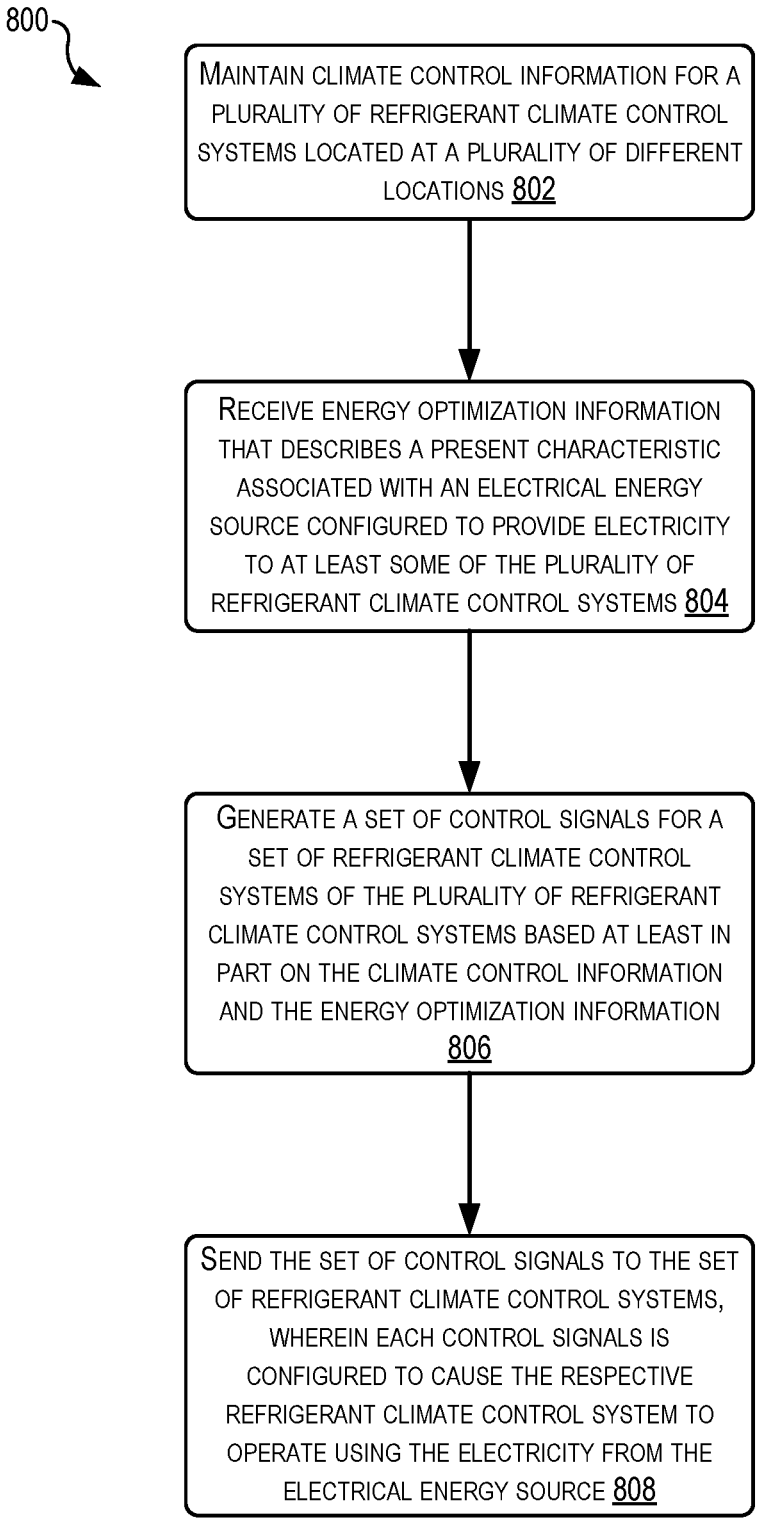
FIG. 8 illustrates a flow chart showing an example process for decoupled and coordinated operation of refrigeration climate control systems using external optimization signals, according to at least one example.

FIG. 8 illustrates a flow chart showing an example process 800 for decoupled and coordinated operation of refrigeration climate control systems using external optimization signals and receiver sensor data, according to at least one example. In particular, FIG. 8 depicts a server-based solution that can send instructions to many different energy management devices to control RCCSs associated with the energy management devices based on energy optimization signal. For example, the server (e.g., the remote system 104) may maintain information about what HVAC systems are being used at each house in a given area (e.g., a municipality, a zone serviced by a grid operator, etc.), and based on an energy optimization signal, instructs the energy management devices that it would be a good time for compressors of the RCCS to operate. Thus, like the other processes, the process 700 aims for opportunistic running of the compressors.

The process 800 begins at block 802 by the remote system 104 maintaining climate control information for a plurality of refrigerant climate control systems located at a plurality of different locations. In some examples, the climate control information may include location information associated with each refrigerant climate control system of the plurality of refrigerant climate control systems. Such information may be stored by the remote system 104 in the EMDs/RCCSs database 240.

At block 804, the process 800 includes receiving energy optimization information that describes a characteristic associated with an electrical energy source configured to provide electricity to at least some of the plurality of refrigerant climate control systems. In some examples, the electrical energy source may include an electrical energy grid including a plurality of energy generation sources. In this example, the energy optimization signal may include at least one of a marginal emissions signal, an average emissions signal, a price signal, or a time signal. The characteristic may include a current characteristic (e.g., a current price, a current emissions signal, etc.) or a forecasted characteristic (e.g., a forecasted price, a forecasted emissions signal, etc.).

At block 806, the process 800 includes generating a set of control signals for a set of refrigerant climate control systems of the plurality of refrigerant climate control systems based at least in part on the climate control information and the energy optimization information. In some examples, the plurality of different locations may be located within a geographic region serviced by the electrical energy source. In this example, generating the set of control signals may include generating the set of control signals to coordinate operation of the set of refrigerant climate control systems. In some examples, each control signal is further configured to cause the respective refrigerant climate control system to operate using the electricity from the electrical energy source to fill a respective receiver with refrigerant.

At block 808, the process 800 includes sending the set of control signals to the set of refrigerant climate control systems, wherein each control signal is configured to cause the respective refrigerant climate control system to operate using the electricity from the electrical energy source. In some examples, sending the set of control signals to the refrigerant climate control system to operate in the determined operating mode may include sending the set of control signals to a plurality of energy management devices located at the plurality of different locations. In some examples, the set of control signals is configured to cause the plurality of energy management devices to proxy the set of control signals to the set of refrigerant climate control systems. In some examples, the set of control signals is configured to cause the plurality of energy management devices to determine control instructions for the respective refrigerant climate control systems.

Figure 9:
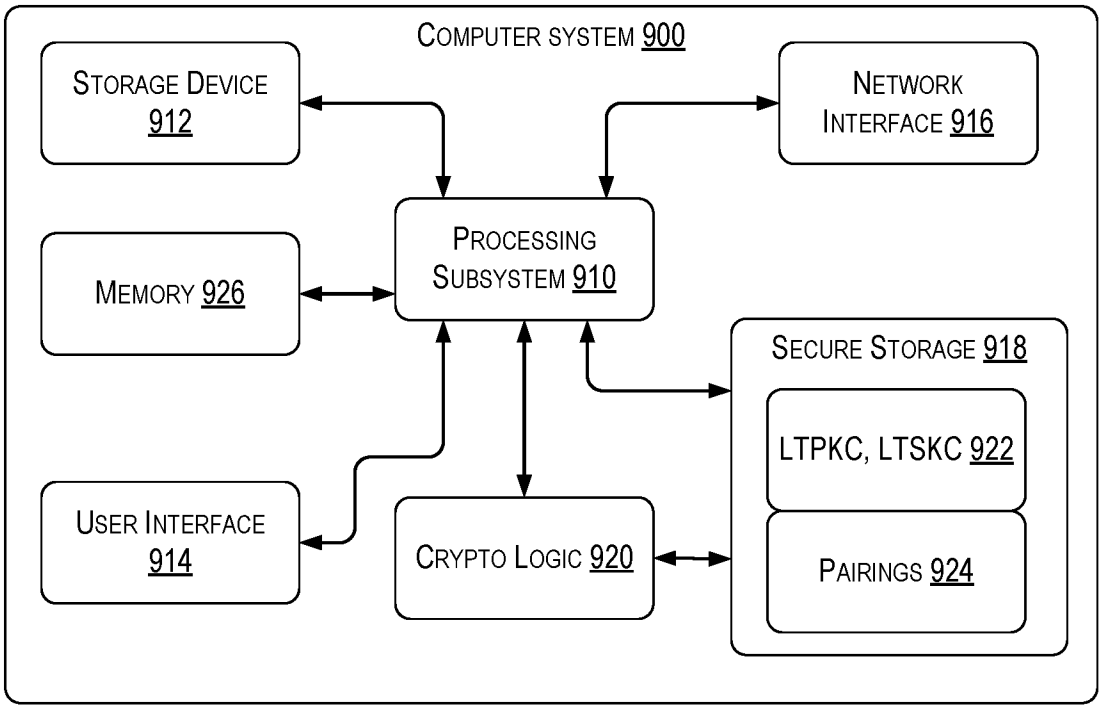
FIG. 9 illustrates an example computer system configured to implement techniques described herein, according to at least one example.

FIG. 9 illustrates an example computer system 900 configured to implement techniques described herein, according to at least one example. The computer system 900 is an example of the energy management device 112, the remote system 104, the RCCS controller 222, and the like. They may be configured to implement any or all of the controller functions, behaviors, and capabilities described herein, as well as other functions, behaviors, and capabilities not expressly described. Computer system 900 can include processing subsystem 910, storage device 912, user interface 914, communication interface 916, secure storage module 918, cryptographic logic module 920, and a memory 926. Computer system 900 can also include other components (not explicitly shown) such as a battery, power controllers, and other components operable to provide various enhanced capabilities. In various embodiments, computer system 900 can be implemented in a desktop computer, laptop computer, tablet computer, smart phone, other mobile phone, wearable computing device, or other systems having any desired form factor. Further, as noted above, computer system 900 can be implemented partly in a base station and partly in a mobile unit that communicates with the base station and provides a user interface.

Storage device 912 can be implemented, e.g., using disk, flash memory, or any other non-transitory storage medium, or a combination of media, and can include volatile and/or non-volatile media. In some embodiments, storage device 912 can store one or more application and/or operating system programs to be executed by processing subsystem 910, including programs to implement various operations described above as being performed by a controller. For example, storage device 912 can store a uniform controller application that can read an accessory description record and generate a graphical user interface for controlling the accessory based on information therein (e.g., as described in above-referenced U.S. application Ser. No. 14/614,914). In some embodiments, portions (or all) of the controller functionality described herein can be implemented in operating system programs rather than applications. In some embodiments, storage device 912 can also store apps designed for specific accessories or specific categories of accessories (e.g., an IP camera app to manage an IP camera accessory or a security app to interact with door lock accessories). Storage device 912 can also store other data produced or used by computer system 900 in the course of its operations, including trigger data objects and/or other data pertaining to an environment model.

User interface 914 can include input devices such as a touch pad, touch screen, scroll wheel, click wheel, dial, button, switch, keypad, microphone, or the like, as well as output devices such as a video screen, indicator lights, speakers, headphone jacks, or the like, together with supporting electronics (e.g., digital-to-analog or analog-to-digital converters, signal processors, or the like). A user can operate input devices of user interface 914 to invoke the functionality of computer system 900 and can view and/or hear output from computer system 900 via output devices of user interface 914.

Processing subsystem 910 can be implemented as one or more integrated circuits, e.g., one or more single-core or multi-core microprocessors or microcontrollers, examples of which are known in the art. In operation, processing system 910 can control the operation of computer system 900. In various embodiments, processing subsystem 910 can execute a variety of programs in response to program code and can maintain multiple concurrently executing programs or processes. At any given time, some or all of the program code to be executed can be resident in processing subsystem 910 and/or in storage media such as storage device 912.

Through suitable programming, processing subsystem 910 can provide various functionality for computer system 900. For example, in some embodiments, processing subsystem 910 can implement various processes (or portions thereof) described above as being implemented by a controller. Processing subsystem 910 can also execute other programs to control other functions of computer system 900, including application programs that may be stored in storage device 912. In some embodiments, these application programs may interact with an accessory, e.g., by generating messages to be sent to the accessory and/or receiving responses from the accessory. Such interactions can be facilitated by an accessory management daemon and/or other operating system processes, e.g., as described above.

Communication interface 916 can provide voice and/or data communication capability for computer system 900. In some embodiments communication interface 916 can include radio frequency (RF) transceiver components for accessing wireless voice and/or data networks (e.g., using cellular telephone technology, data network technology such as 3G, 4G/LTE, Wi-Fi, other IEEE 902.11 family standards, or other mobile communication technologies, or any combination thereof), components for short-range wireless communication (e.g., using Bluetooth and/or Bluetooth LE standards, NFC, etc.), and/or other components. In some embodiments communication interface 916 can provide wired network connectivity (e.g., Ethernet) in addition to or instead of a wireless interface. Communication interface 916 can be implemented using a combination of hardware (e.g., driver circuits, antennas, modulators/demodulators, encoders/decoders, and other analog and/or digital signal processing circuits) and software components. In some embodiments, communication interface 916 can support multiple communication channels concurrently or at different times, using the same transport or different transports.

Secure storage module 918 can be an integrated circuit or the like that can securely store cryptographic information for computer system 900. Examples of information that can be stored within secure storage module 918 include the controller's long-term public and secret keys 922 (LTPKC, LTSKC as described above), and a list of paired accessories 924 (e.g., a lookup table that maps accessory ID to accessory long-term public key LTPKA for accessories that have completed a pair setup or pair add process as described above).

In some embodiments, cryptographic operations can be implemented in a cryptographic logic module 920 that communicates with secure storage module 918. Physically, cryptographic logic module 920 can be implemented in the same integrated circuit with secure storage module 918 or a different integrated circuit (e.g., a processor in processing subsystem 910) as desired. Cryptographic logic module 920 can include various logic circuits (fixed or programmable as desired) that implement or support cryptographic operations of computer system 900, including any or all cryptographic operations described above. Secure storage module 918 and/or cryptographic logic module 920 can appear as a "black box" to the rest of computer system 900. Thus, for instance, communication interface 916 can receive a message in encrypted form that it cannot decrypt and can simply deliver the message to processing subsystem 910. Processing subsystem 910 may also be unable to decrypt the message, but it can recognize the message as encrypted and deliver it to cryptographic logic module 920. Cryptographic logic module 920 can decrypt the message (e.g., using information extracted from secure storage module 918) and determine what information to return to processing subsystem 910. As a result, certain information can be available only within secure storage module 918 and cryptographic logic module 920. If secure storage module 918 and cryptographic logic module 920 are implemented on a single integrated circuit that executes code only from an internal secure repository, this can make extraction of the information extremely difficult, which can provide a high degree of security. Other implementations are also possible.

The memory 926 may be configured to store modules, engines, services, or the like for performing the techniques described herein. For example, depending on the implementation, the memory 926 may store the RCCS control engine, optimization engine, the energy signal engine, the power coordination engine, the RCCS controller, and any other suitable engine.

The various examples can be further implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially available operating systems and other known applications for purposes such as development and database management. These devices also can include other electronic devices, such as dummy terminals, thin-clients, gaming systems, and other devices capable of communicating via a network.

Most examples utilize at least one network that would be familiar to those skilled in the art for supporting communications using any of a variety of commercially available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

In examples utilizing a network server, the network server can run any of a variety of server or mid-tier applications, including HTTP servers, FTP servers, CGI servers, data servers, Java servers, and business application servers. The server(s) may also be capable of executing programs or scripts in response to requests from user devices, such as by executing one or more applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of examples, the information may reside in a storage-area network (SAN) familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, keypad), and at least one output device (e.g., a display device, printer, speaker). Such a system may also include one or more storage devices, such as disk drives, optical storage devices, and solid-state storage devices such as RAM or ROM, as well as removable media devices, memory cards, flash cards, etc.

Such devices can also include a computer-readable storage media reader, a communications device (e.g., a modem, a network card (wireless or wired), an infrared communication device), and working memory as described above. The computer-readable storage media reader can be connected with, or configured to receive, a non-transitory computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or browser. It should be appreciated that alternate examples may have numerous variations from that described above. For example, customized hardware might also be used and/or particular elements might be implemented in hardware, software (including portable software, such as applets), or both. Further, connection to other computing devices such as network input/output devices may be employed.

Non-transitory storage media and computer-readable media for containing code, or portions of code, can include any appropriate media known or used in the art, including storage media, such as, but not limited to, volatile and non-volatile, removable and non-removable media implemented in any method or technology for storage of information such as computer-readable instructions, data structures, program modules, or other data, including RAM, ROM, EEPROM, flash memory or other memory technology, CD-ROM, DVD or other optical storage, magnetic cassettes, magnetic tape, magnetic disk storage or other magnetic storage devices, or any other medium which can be used to store the desired information and which can be accessed by a system device. Based at least in part on the disclosure and teachings provided herein, a person of ordinary skill in the art will appreciate other ways and/or methods to implement the various examples.

In the following, further clauses are described to facilitate the understanding of the present disclosure.

Clause 1. A computer-implemented method, comprising:

receiving, at an energy management device, an energy optimization signal that describes a characteristic associated with an electrical energy source, wherein the characteristic is a present characteristic or a forecasted characteristic;

generating, by the energy management device, a control signal for a refrigerant climate control system to use the electrical energy source based at least in part on the characteristic of the energy optimization signal; and providing, by the energy management device, the control signal to a controller of the refrigerant climate control system.

Clause 2. The computer-implemented method of clause 1, wherein receiving the energy optimization signal comprises receiving the energy optimization signal from a remote system that monitors characteristics associated with the electrical energy source.

Clause 3. The computer-implemented method of clause 1, wherein the electrical energy source comprises an electrical energy grid comprising a plurality of energy generation sources, and wherein the energy optimization signal comprises at least one of a marginal emissions signal, an average emissions signal, a price signal, or a time signal.

Clause 4. The computer-implemented method of clause 1, wherein the electrical energy source comprises a residential power generation system.

Clause 5. The computer-implemented method of clause 11, wherein the energy management device comprises a home automation system configured to control operation of connected accessories at a dwelling, and the refrigerant climate control system comprises an air conditioning system or a heat pump system of the dwelling.

Clause 6. The computer-implemented method of clause 1, wherein generating the control signal for the refrigerant climate control system comprises optimizing electrical energy use of the refrigerant climate control system based on the energy optimization signal.

Clause 7. The computer-implemented method of clause 1, wherein:

the control signal comprises a binary flag;

in a first state of the binary flag, the binary flag is interpreted by the controller of the refrigerant climate control as a first suggestion to operate a compressor of the refrigerant climate control system; and in a second state of the binary flag, the binary flag is interpreted by the controller of the refrigerant climate control as a second suggestion to refrain from operating the compressor of the refrigerant climate control system.

Clause 8. The computer-implemented method of clause 1, wherein the control signal comprises a set of instructions that, when executed by the controller, cause the controller to operate a compressor of the refrigerant climate control system in one of a plurality of modes.

Clause 9. The computer-implemented method of clause 8, wherein the plurality of modes comprises a first mode that fills a receiver of the refrigerant climate control system, and a second mode that serves current demand of the refrigerant climate control system.

Clause 10. An energy management device, comprising:

a memory comprising computer-executable instructions; and a processor configured to access the memory and execute the computer-executable instructions to at least:

receive an energy optimization signal that describes a characteristic associated with an electrical energy source, wherein the characteristic is a present characteristic or a forecasted characteristic;

generate a control signal for a refrigerant climate control system to use the electrical energy source based at least in part on the characteristic of the energy optimization signal; and provide the control signal to a controller of the refrigerant climate control system.

Clause 11. The energy management device of clause 10, wherein receiving the energy optimization signal comprises receiving the energy optimization signal from a remote system that monitors characteristics associated with the electrical energy source.

Clause 12. The energy management device of clause 10, wherein the electrical energy source comprises an electrical energy grid comprising a plurality of energy generation sources, and wherein the energy optimization signal comprises at least one of a marginal emissions signal, an average emissions signal, a price signal, or a time signal.

Clause 13. The energy management device of clause 10, wherein the electrical energy source comprises at least one of a residential solar generation system or a residential battery power system.

Clause 14. The energy management device of clause 10, wherein generating the control signal for the refrigerant climate control system comprises optimizing electrical energy use of the refrigerant climate control system based on the energy optimization signal.

Clause 15. The energy management device of clause 10, wherein the control signal comprises a set of instructions that, when executed by the controller, cause the controller to operate a compressor of the refrigerant climate control system in one of a plurality of modes.

Clause 16. One or more non-transitory computer-readable media comprising computer-executable instructions that, when executed by one or more processors of an energy management device, cause the energy management device to perform operations comprising:

receiving, at the energy management device, an energy optimization signal that describes a characteristic associated with an electrical energy source, wherein the characteristic is a present characteristic or a forecasted characteristic;

generating, by the energy management device, a control signal for a refrigerant climate control system to use the electrical energy source based at least in part on the characteristic of the energy optimization signal; and providing, by the energy management device, the control signal to a controller of the refrigerant climate control system.

Clause 17. The one or more non-transitory computer-readable media of clause 16, wherein:

the control signal comprises a binary flag;

in a first state of the binary flag, the binary flag is interpreted by the controller of the refrigerant climate control as a first suggestion to operate a compressor of the refrigerant climate control system; and in a second state of the binary flag, the binary flag is interpreted by the controller of the refrigerant climate control as a second suggestion to refrain from operating the compressor of the refrigerant climate control system.

Clause 18. The one or more non-transitory computer-readable media of clause 16, wherein the control signal comprises a set of instructions that, when executed by the controller, cause the controller to operate a compressor of the refrigerant climate control system in one of a plurality of modes.

Clause 19. The one or more non-transitory computer-readable media of clause 18, wherein the plurality of modes comprises a first mode that fills a receiver of the refrigerant climate control system, and a second mode that serves current demand of the refrigerant climate control system.

Clause 20. The one or more non-transitory computer-readable media of clause 16, wherein receiving the energy optimization signal comprises receiving the energy optimization signal from a remote system that monitors characteristics associated with the electrical energy source.

Clause 21. A computer-implemented method, comprising:

receiving sensor data corresponding to a current state of a refrigerant in a receiver of a refrigerant climate control system;

receiving an energy control signal requesting operation of the refrigerant climate control system;

determining an operating mode of the refrigerant climate control system based on a signal type of the energy control signal and the current state of the refrigerant in the receiver; and instructing the refrigerant climate control system to operate in the determined operating mode.

Clause 22. The computer-implemented method of clause 21, wherein the operating mode comprises one of a plurality of operating modes corresponding to selective operation of a compressor of the refrigerant climate control system and selective operation of an expansion valve of the refrigerant climate control system.

Clause 23. The computer-implemented method of clause 21, wherein determining the operating mode comprises determining the operating mode as a first operating mode of the plurality of operating modes when the sensor data indicates that the current state is below a minimum value of refrigerant in the receiver and the signal type of energy control signal comprises a temperature control signal.

Clause 24. The computer-implemented method of clause 23, wherein, in the first operating mode, the refrigerant climate control system operates the compressor of the refrigerant climate control system and opens the expansion valve of the refrigerant climate control system.

Clause 25. The computer-implemented method of clause 22, wherein determining the operating mode comprises determining the operating mode as a second operating mode of the plurality of operating modes when the sensor data indicates that the current state is below a minimum value of refrigerant in the receiver and the signal type of energy control signal comprises a pre-compress control signal.

Clause 26. The computer-implemented method of clause 25, wherein, in the second operating mode, the refrigerant climate control system operates the compressor of the refrigerant climate control system and closes the expansion valve of the refrigerant climate control system.

Clause 27. The computer-implemented method of clause 22, wherein determining the operating mode comprises determining the operating mode as a third operating mode of the plurality of operating modes when the sensor data indicates that the current state is between a minimum value and maximum value of refrigerant in the receiver and the signal type of energy control signal comprises a temperature control signal.

Clause 28. The computer-implemented method of clause 27, wherein, in the third operating mode, the refrigerant climate control system refrains from operating the compressor of the refrigerant climate control system and opens the expansion valve of the refrigerant climate control system.

Clause 29. The computer-implemented method of clause 22, wherein determining the operating mode comprises determining the operating mode as a fourth operating mode of the plurality of operating modes when the sensor data indicates that the current state is between a minimum value and maximum value of refrigerant in the receiver and the signal type of energy control signal comprises a pre-compress control signal.

Clause 30. The computer-implemented method of clause 29, wherein, in the fourth operating mode, the refrigerant climate control system operates the compressor of the refrigerant climate control system and closes the expansion valve of the refrigerant climate control system.

Clause 31. The computer-implemented method of clause 22, wherein determining the operating mode comprises determining the operating mode as a fifth operating mode of the plurality of operating modes when the sensor data indicates that the current state exceeds a maximum value of refrigerant in the receiver and the signal type of energy control signal comprises a temperature control signal.

Clause 32. The computer-implemented method of clause 31, wherein, in the fifth operating mode, the refrigerant climate control system refrains from operating the compressor of the refrigerant climate control system and closes the expansion valve of the refrigerant climate control system.

Clause 33. The computer-implemented method of clause 22, wherein determining the operating mode comprises determining the operating mode as a sixth operating mode of the plurality of operating modes when the sensor data indicates that the current state exceeds a maximum value of refrigerant in the receiver and the signal type of energy control signal comprises a pre-compress control signal.

Clause 34. The computer-implemented method of clause 33, wherein, in the sixth operating mode, the refrigerant climate control system refrains from operating the compressor of the refrigerant climate control system and refrains from operating the expansion valve of the refrigerant climate control system.

Clause 35. An electronic device, comprising:

a memory comprising computer-executable instructions; and a processor configured to access the memory and execute the computer-executable instructions to at least:

receive sensor data corresponding to a current state of a refrigerant in a receiver of a refrigerant climate control system;

receive an energy control signal requesting operation of the refrigerant climate control system;

determine an operating mode of the refrigerant climate control system based on a signal type of the energy control signal and the current state of the refrigerant in the receiver; and instruct the refrigerant climate control system to operate in the determined operating mode.

Clause 36. The electronic device of clause 35, wherein the signal type comprises at least one of a setpoint signal from a thermostat or an energy optimization signal.

Clause 37. The electronic device of clause 36, wherein the energy optimization signal comprises at least one of a marginal emissions signal, an average emissions signal, a price signal, or a time signal.

Clause 38. The electronic device of clause 35, wherein instructing the refrigerant climate control system in the determined operating mode comprises:

generating a plurality of control signals; and providing individual control signals of the plurality of control signals to components of the refrigerant climate control system comprising at least a compressor and expansion valve.

Clause 39. One or more non-transitory computer-readable media comprising computer-executable instructions that, when executed by one or more processors of an electronic device, cause the electronic device to perform operations comprising:

receiving sensor data corresponding to a current state of a refrigerant in a receiver of a refrigerant climate control system;

receiving an energy control signal requesting operation of the refrigerant climate control system;

determining an operating mode of the refrigerant climate control system based on a signal type of the energy control signal and the current state of the refrigerant in the receiver; and instructing the refrigerant climate control system to operate in the determined operating mode.

Clause 40. The one or more non-transitory computer-readable media of clause 39, wherein the electronic device comprises an energy management device that is separate from the refrigerant climate control system.

Clause 41. A computer-implemented method, comprising:

maintaining climate control information for a plurality of refrigerant climate control systems located at a plurality of different locations;

receiving energy optimization information that describes a characteristic associated with an electrical energy source configured to provide electricity to at least some of the plurality of refrigerant climate control systems, wherein the characteristic is a present characteristic or a forecasted characteristic; and generating a set of control signals for a set of refrigerant climate control systems of the plurality of refrigerant climate control systems based at least in part on the climate control information and the energy optimization information; and sending the set of control signals to the set of refrigerant climate control systems, wherein each control signal is configured to cause the respective refrigerant climate control system to operate using the electricity from the electrical energy source.

Clause 42. The computer-implemented method of clause 41, wherein the climate control information comprises location information associated with each refrigerant climate control system of the plurality of refrigerant climate control systems.

Clause 43. The computer-implemented method of clause 41, wherein the plurality of different locations is located within a geographic region serviced by the electrical energy source, and wherein generating the set of control signals comprises generating the set of control signals to coordinate operation of the set of refrigerant climate control systems.

Clause 44. The computer-implemented method of clause 41, wherein the electrical energy source comprises an electrical energy grid comprising a plurality of energy generation sources, and wherein the energy optimization information comprises at least one of a marginal emissions signal, an average emissions signal, a price signal, or a time signal.

Clause 45. The computer-implemented method of clause 41, wherein each control signal is further configured to cause the respective refrigerant climate control system to operate using the electricity from the electrical energy source to fill a respective receiver with refrigerant.

Clause 46. The computer-implemented method of clause 41, wherein sending the set of control signals to the refrigerant climate control system to operate in the determined operating mode comprises sending the set of control signals to a plurality of energy management devices located at the plurality of different locations.

Clause 47. The computer-implemented method of clause 46, wherein the set of control signals is configured to cause the plurality of energy management devices to proxy the set of control signals to the set of refrigerant climate control systems.

Clause 48. The computer-implemented method of clause 46, wherein the set of control signals is configured to cause the plurality of energy management devices to determine control instructions for the respective refrigerant climate control systems.

Clause 49. A computer system, comprising:

a memory comprising computer-executable instructions; and a processor configured to access the memory and execute the computer-executable instructions to at least:

maintain climate control information for a plurality of refrigerant climate control systems located at a plurality of different locations;

receive energy optimization information that describes a characteristic associated with an electrical energy source configured to provide electricity to at least some of the plurality of refrigerant climate control systems, wherein the characteristic is a present characteristic or a forecasted characteristic; and generate a set of control signals for a set of refrigerant climate control systems of the plurality of refrigerant climate control systems based at least in part on the climate control information and the energy optimization information; and send the set of control signals to the set of refrigerant climate control systems, wherein each control signal of the set of control signals is configured to cause the respective refrigerant climate control system to operate using the electricity from the electrical energy source.

Clause 50. The computer system of clause 49, wherein the climate control information comprises location information associated with each refrigerant climate control system of the plurality of refrigerant climate control systems.

Clause 51. The computer system of clause 49, wherein the plurality of different locations is located within a geographic region serviced by the electrical energy source, and wherein generating the set of control signals comprises generating the set of control signals to coordinate operation of the set of refrigerant climate control systems.

Clause 52. The computer system of clause 49, wherein the electrical energy source comprises an electrical energy grid comprising a plurality of energy generation sources, and wherein the energy optimization information comprises at least one of a marginal emissions signal, an average emissions signal, a price signal, or a time signal.

Clause 53. The computer system of clause 49, wherein each control signal is further configured to cause the respective refrigerant climate control system to operate using the electricity from the electrical energy source to fill a respective receiver with refrigerant.

Clause 54. One or more non-transitory computer-readable media comprising computer-executable instructions that, when executed by one or more processors of an electronic device, cause the electronic device to perform operations comprising:

maintaining climate control information for a plurality of refrigerant climate control systems located at a plurality of different locations;

receiving energy optimization information that describes a characteristic associated with an electrical energy source configured to provide electricity to at least some of the plurality of refrigerant climate control systems, wherein the characteristic is a present characteristic or a forecasted characteristic; and generating a set of control signals for a set of refrigerant climate control systems of the plurality of refrigerant climate control systems based at least in part on the climate control information and the energy optimization information; and sending the set of control signals to the set of refrigerant climate control systems, wherein each control signal is configured to cause the respective refrigerant climate control system to operate using the electricity from the electrical energy source.

Clause 55. The one or more non-transitory computer-readable media of clause 54, wherein sending the set of control signals to the refrigerant climate control system to operate in the determined operating mode comprises sending the set of control signals to a plurality of energy management devices located at the plurality of different locations.

Clause 56. The one or more non-transitory computer-readable media of clause 55, wherein the set of control signals is configured to cause the plurality of energy management devices to proxy the set of control signals to the set of refrigerant climate control systems.

Clause 57. The one or more non-transitory computer-readable media of clause 55, wherein the set of control signals is configured to cause the plurality of energy management devices to determine control instructions for the respective refrigerant climate control systems.

Clause 58. The one or more non-transitory computer-readable media of clause 54, wherein the climate control information comprises location information associated with each refrigerant climate control system of the plurality of refrigerant climate control systems.

Clause 59. The one or more non-transitory computer-readable media of clause 54, wherein the plurality of different locations is located within a geographic region serviced by the electrical energy source, and wherein generating the set of control signals comprises generating the set of control signals to coordinate operation of the set of refrigerant climate control systems.

Clause 60. The one or more non-transitory computer-readable media of clause 54, wherein the electrical energy source comprises an electrical energy grid comprising a plurality of energy generation sources, and wherein the energy optimization information comprises at least one of a marginal emissions signal, an average emissions signal, a price signal, or a time signal.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated examples thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed examples (especially in the context of the following claims) are to be construed to cover both the singular and the plural, unless otherwise indicated herein or clearly contradicted by context. The terms "comprising," "having," "including," and "containing" are to be construed as open-ended terms (e.g., meaning "including, but not limited to") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate examples of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is otherwise understood within the context as used in general to present that an item, term, etc., may be either X, Y, or Z, or any combination thereof (e.g., X, Y, and/or Z). Thus, such disjunctive language is not generally intended to, and should not, imply that certain examples require at least one of X, at least one of Y, or at least one of Z to each be present.

Preferred examples of this disclosure are described herein, including the best mode known to the inventors for carrying out the disclosure. Variations of those preferred examples may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

As described above, one aspect of the present technology is the gathering and use of data available from various sources to provide a comprehensive and complete window to a user's personal health record. The present disclosure contemplates that in some instances, this gathered data may include personally identifiable information (PII) data that uniquely identifies or can be used to contact or locate a specific person. Such personal information data can include demographic data, location-based data, telephone numbers, email addresses, Twitter IDs, home addresses, data or records relating to a user's health or level of fitness (e.g., vital sign measurements, medication information, exercise information), date of birth, health record data, or any other identifying or personal or health information.

The present disclosure recognizes that the use of such personal information data, in the present technology, can be used to the benefit of users. For example, the personal information data can be used to provide enhancements to a user's personal health record. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the U.S., collection of or access to certain health data may be governed by federal and/or state laws, such as the Health Insurance Portability and Accountability Act (HIPAA); whereas health data in other countries may be subject to other regulations and policies and should be handled accordingly. Hence, different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services or other services relating to health record management, the present technology can be configured to allow users to select to "opt in" or "opt out" of participation in the collection of personal information data during registration for services or anytime thereafter. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health-related applications, data de-identification can be used to protect a user's privacy. De-identification may be facilitated, when appropriate, by removing specific identifiers (e.g., date of birth), controlling the amount or specificity of data stored (e.g., collecting location data at a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data.

What is claimed is:

1. A computer-implemented method, comprising:

maintaining climate control information for a plurality of refrigerant climate control systems located at a plurality of different geographic locations within a predefined geographic region, wherein each refrigerant climate control system of the plurality of refrigerant climate control systems comprises a system that utilizes refrigerant to transfer heat from one location to another;

receiving energy optimization information that describes a characteristic associated with an electrical energy grid comprising a plurality of energy generation sources configured to provide electricity to at least some of the plurality of refrigerant climate control systems located within the predefined geographic region, wherein the characteristic is a present characteristic or a forecasted characteristic; and generating a set of control signals for a set of refrigerant climate control systems of the plurality of refrigerant climate control systems based at least in part on the climate control information and the energy optimization information; and sending the set of control signals to the set of refrigerant climate control systems, wherein each control signal is configured to cause the respective refrigerant climate control system to operate using the electricity from the electrical energy source.

2. The computer-implemented method of claim 1, wherein the climate control information comprises location information associated with each refrigerant climate control system of the plurality of refrigerant climate control systems.

3. The computer-implemented method of claim 1, wherein the plurality of different geographic locations is located within the predefined geographic region serviced by the electrical energy grid, and wherein generating the set of control signals comprises generating the set of control signals to coordinate operation of the set of refrigerant climate control systems.

4. The computer-implemented method of claim 1, wherein the energy optimization information comprises at least one of a marginal emissions signal, an average emissions signal, a price signal, or a time signal.

5. The computer-implemented method of claim 1, wherein each control signal is further configured to cause the respective refrigerant climate control system to operate using the electricity from the electrical energy grid to fill a respective receiver with refrigerant.

6. The computer-implemented method of claim 1, wherein sending the set of control signals to the refrigerant climate control system to operate in the determined operating mode comprises sending the set of control signals to a plurality of energy management devices located at the plurality of different geographic locations.

7. The computer-implemented method of claim 6, wherein the set of control signals is configured to cause the plurality of energy management devices to proxy the set of control signals to the set of refrigerant climate control systems.

8. The computer-implemented method of claim 6, wherein the set of control signals is configured to cause the plurality of energy management devices to determine control instructions for the respective refrigerant climate control systems.

9. A computer system, comprising:

a memory comprising computer-executable instructions; and a processor configured to access the memory and execute the computer-executable instructions to at least:

maintain climate control information for a plurality of refrigerant climate control systems located at a plurality of different geographic locations within a predefined geographic region, wherein each refrigerant climate control system of the plurality of refrigerant climate control systems comprises a system that utilizes refrigerant to transfer heat from one location to another;

receive energy optimization information that describes a characteristic associated with an electrical energy grid comprising a plurality of energy generation sources configured to provide electricity to at least some of the plurality of refrigerant climate control systems located within the predefined geographic region, wherein the characteristic is a present characteristic or a forecasted characteristic; and generate a set of control signals for a set of refrigerant climate control systems of the plurality of refrigerant climate control systems based at least in part on the climate control information and the energy optimization information; and send the set of control signals to the set of refrigerant climate control systems, wherein each control signal of the set of control signals is configured to cause the respective refrigerant climate control system to operate using the electricity from the electrical energy source.

10. The computer system of claim 9, wherein the climate control information comprises location information associated with each refrigerant climate control system of the plurality of refrigerant climate control systems.

11. The computer system of claim 9, wherein the plurality of different geographic locations is located within the predefined geographic region serviced by the electrical energy grid, and wherein generating the set of control signals comprises generating the set of control signals to coordinate operation of the set of refrigerant climate control systems.

12. The computer system of claim 9, wherein the energy optimization information comprises at least one of a marginal emissions signal, an average emissions signal, a price signal, or a time signal.

13. The computer system of claim 9, wherein each control signal is further configured to cause the respective refrigerant climate control system to operate using the electricity from the electrical energy grid to fill a respective receiver with refrigerant.

14. One or more non-transitory computer-readable media comprising computer-executable instructions that, when executed by one or more processors of an electronic device, cause the electronic device to perform operations comprising:

maintaining climate control information for a plurality of different refrigerant climate control systems located at a plurality of different geographic locations within a predefined geographic region, wherein each refrigerant climate control system of the plurality of refrigerant climate control systems comprises a system that utilizes refrigerant to transfer heat from one location to another;

receiving energy optimization information that describes a characteristic associated with an electrical energy grid comprising a plurality of energy generation sources configured to provide electricity to at least some of the plurality of refrigerant climate control systems located within the predefined geographic region, wherein the characteristic is a present characteristic or a forecasted characteristic; and generating a set of control signals for a set of refrigerant climate control systems of the plurality of refrigerant climate control systems based at least in part on the climate control information and the energy optimization information; and sending the set of control signals to the set of refrigerant climate control systems, wherein each control signal is configured to cause the respective refrigerant climate control system to operate using the electricity from the electrical energy source.

15. The one or more non-transitory computer-readable media of claim 14, wherein sending the set of control signals to the refrigerant climate control system to operate in the determined operating mode comprises sending the set of control signals to a plurality of energy management devices located at the plurality of different geographic locations.

16. The one or more non-transitory computer-readable media of claim 15, wherein the set of control signals is configured to cause the plurality of energy management devices to proxy the set of control signals to the set of refrigerant climate control systems.

17. The one or more non-transitory computer-readable media of claim 15, wherein the set of control signals is configured to cause the plurality of energy management devices to determine control instructions for the respective refrigerant climate control systems.

18. The one or more non-transitory computer-readable media of claim 14, wherein the climate control information comprises location information associated with each refrigerant climate control system of the plurality of refrigerant climate control systems.

19. The one or more non-transitory computer-readable media of claim 14, wherein the plurality of different geographic locations is located within the predefined geographic region serviced by the electrical energy grid, and wherein generating the set of control signals comprises generating the set of control signals to coordinate operation of the set of refrigerant climate control systems.

20. The one or more non-transitory computer-readable media of claim 14, and wherein the energy optimization information comprises at least one of a marginal emissions signal, an average emissions signal, a price signal, or a time signal.

* * * * *